US008875340B2

(12) United States Patent
Conrad

(10) Patent No.: US 8,875,340 B2
(45) Date of Patent: Nov. 4, 2014

(54) SURFACE CLEANING APPARATUS WITH ENHANCED OPERABILITY

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 927 days.

(21) Appl. No.: 12/722,874

(22) Filed: Mar. 12, 2010

(65) Prior Publication Data

US 2011/0219573 A1 Sep. 15, 2011

(51) Int. Cl.
*A47L 5/32* (2006.01)
*A47L 5/22* (2006.01)
*A47L 9/24* (2006.01)

(52) U.S. Cl.
CPC *A47L 5/225* (2013.01); *A47L 9/242* (2013.01)
USPC ..... 15/335; 15/334; 15/329

(58) Field of Classification Search
CPC ..... A47L 5/32; A47L 5/225
USPC ..... 15/328, 329, 331, 334, 335
See application file for complete search history.

(56) References Cited

U.S. PATENT DOCUMENTS

| | | | | |
|---|---|---|---|---|
| 5,078,761 | A | 1/1992 | Dyson | |
| 5,129,125 | A * | 7/1992 | Gamou et al. | 15/352 |
| 5,524,321 | A * | 6/1996 | Weaver et al. | 15/329 |
| 6,311,366 | B1 * | 11/2001 | Sepke et al. | 15/412 |
| 6,735,818 | B2 * | 5/2004 | Hamada et al. | 15/410 |
| 6,740,144 | B2 * | 5/2004 | Conrad et al. | 96/57 |
| 6,779,229 | B2 * | 8/2004 | Lee et al. | 15/329 |
| 6,948,212 | B2 * | 9/2005 | Oh et al. | 15/328 |
| 6,961,975 | B2 * | 11/2005 | Park et al. | 15/329 |
| 7,000,288 | B2 * | 2/2006 | Nighy | 15/327.1 |
| 7,014,671 | B2 * | 3/2006 | Oh | 55/337 |
| 7,036,183 | B2 * | 5/2006 | Gammack et al. | 15/335 |
| 7,166,141 | B2 * | 1/2007 | Skinner Macleod et al. | 55/337 |
| 7,181,803 | B2 * | 2/2007 | Park et al. | 15/334 |
| 7,203,991 | B2 * | 4/2007 | Stephens et al. | 15/320 |
| 7,356,874 | B2 * | 4/2008 | Skinner Macleod et al. | 15/328 |
| 7,377,007 | B2 * | 5/2008 | Best | 15/329 |
| 7,377,008 | B2 * | 5/2008 | Park et al. | 15/329 |
| 7,430,783 | B2 * | 10/2008 | Williams et al. | 15/320 |
| 7,584,522 | B1 * | 9/2009 | Weeter et al. | 15/350 |
| 7,832,050 | B2 * | 11/2010 | Pullins et al. | 15/410 |
| 7,891,050 | B2 * | 2/2011 | Liddell | 15/410 |

(Continued)

FOREIGN PATENT DOCUMENTS

WO 2009/026709 A1 3/2009

*Primary Examiner* — William Gilbert
*Assistant Examiner* — Alp Akbasli
(74) *Attorney, Agent, or Firm* — Philip C. Mendes da Costa; Bereskin & Parr LLP/S.E.N.C.R.L., s.r.l.

(57) ABSTRACT

An upright surface cleaning apparatus comprises a floor cleaning head having a dirty air inlet and an upright section moveably mounted to the surface cleaning head. The surface cleaning apparatus also includes an air flow passage extending from the dirty air inlet to a clean air outlet. The air flow passage includes a conduit section. The surface cleaning apparatus also includes a suction motor and an air treatment member positioned in the air flow passage, provided in one of the floor cleaning head and the upright section. The conduit section has an inlet end and an outlet end. The inlet end is rotatably connected to the air flow passage about an axis parallel to air flow through the inlet end, and the outlet end is rotatably connected to the air flow passage about an axis parallel to air flow through the outlet end.

22 Claims, 10 Drawing Sheets

(56) References Cited

U.S. PATENT DOCUMENTS

| | | | | |
|---|---|---|---|---|
| 8,127,398 | B2 * | 3/2012 | Conrad | 15/327.5 |
| 8,370,993 | B2 * | 2/2013 | Conrad | 15/411 |
| 8,646,147 | B2 * | 2/2014 | Conrad | 15/329 |
| 2007/0209142 | A1 * | 9/2007 | Pullins et al. | 15/334 |
| 2007/0289085 | A1 * | 12/2007 | Yoo | 15/334 |
| 2009/0056061 | A1 * | 3/2009 | Andrup et al. | 15/350 |

* cited by examiner

SURFACE CLEANING APPARATUS WITH ENHANCED OPERABILITY

FIELD

This disclosure relates to surface cleaning apparatuses, such as vacuum cleaners. Particularly, the disclosure relates to an air flow passage including a conduit section having two rotatable connections.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

In accordance with a first aspect, a surface cleaning apparatus is provided that includes an air flow path, preferably comprising a hose, wherein each end of portion of the air flow path has a rotatable connection. The provision of the rotatable connection at each end provides enhanced maneuverability of a floor cleaning head. For example, the surface cleaning apparatus may comprise a floor cleaning head and an air flow path leading to an air treatment member and a suction motor, the air flow path including a flexible hose. As the floor cleaning head is moved, the hose may be stretched and contracted. If the floor cleaning head is moved left or right, the hose may twist. Also, as the floor cleaning head is moved forwardly, the hose may be stretched. If a kink develops in the hose, the hose may collapse upon itself. This may be particularly an issue if a hose with a large stretch factor (e.g., 3:1 or more) is utilized. In order to reduce the tendency for a kink to occur, the hose or other part of the air flow path may be connected to a conduit having an inlet end and an outlet end wherein each end is rotatable connected to another member of the air flow path. For example, the hose may be connected to an inlet end of the conduit and the outlet end of the conduit may be rotatably mounted to a part of a housing of the surface cleaning apparatus. Accordingly, the maneuverability of the floor cleaning head may be enhanced without an increase in the risk that the hose may be damaged by being kinked due to movement of the floor cleaning head and/or a hand carriable.

For example, if the hose if rotatably mounted to a rigid conduit, e.g., an elbow, and the rigid conduit is rotatably mounted to a wall of a housing, then rotation is provided in two axis, which may be orthogonal to each other. Accordingly, as the hose is moved, the hose mount (e.g. an elbow) may rotate to permit the hose to be extended and moved in a particular direction without becoming kinked.

In accordance with this aspect, an upright surface cleaning apparatus comprises a floor cleaning head having a dirty air inlet and an upright section moveably mounted to the surface cleaning head. The upright section is moveable between a storage position and an in use position. The surface cleaning apparatus also includes an air flow passage extending from the dirty air inlet to a clean air outlet. The air flow passage includes a conduit section. The surface cleaning apparatus also includes a suction motor and an air treatment member positioned in the air flow passage, provided in one of the floor cleaning head and the upright section. The conduit section has an inlet end and an outlet end. The inlet end is rotatably connected to the air flow passage about an axis parallel to air flow through the inlet end, and the outlet end is rotatably connected to the air flow passage about an axis parallel to air flow through the outlet end.

In some examples the passage comprises a hose and the surface cleaning apparatus further comprises a cleaning unit removably mounted to the upright section. The cleaning unit includes the suction motor and is removable from the upright section with the conduit and the hose. The cleaning unit is useable when removed from the upright section.

In some examples the outlet end of the conduit is rotatably mounted to the cleaning unit and the inlet end is rotatably mounted to the hose.

In some examples, the conduit section comprises an elbow.

In some examples the surface cleaning apparatus includes a cleaning unit removably mounted to the upright section and including the suction motor.

In some examples, the conduit section is removable from the upright section with the cleaning unit.

In some examples, the passage comprises a hose.

In some examples the hose is rotatably connected to one of the inlet and outlet ends of the conduit section.

In some examples, the inlet and outlet ends are oriented in differing directions.

In some examples, the conduit section comprises an elbow.

In some examples, the passage comprises a hose. The hose is rotatably mounted to the inlet end and the hose is releasably mounted to the inlet end.

In some examples, the outlet end of the conduit is rotatably mounted to the cleaning unit and the outlet end is releasably mounted to the cleaning unit.

In some examples, the outlet end of the conduit is rotatably mounted to the cleaning unit and the outlet end is releasably mounted to the cleaning unit.

In some examples, the air treatment member comprises a cyclone having an air inlet and the outlet end of the conduit is linearly aligned with the air inlet of the cyclone.

In some examples, the air treatment member comprises a cyclone having an air inlet and the outlet end of the conduit and the air inlet of the cyclone are in a common plane.

In some examples, the passage comprises a hose rotatably mounted to the inlet end of the conduit. The surface cleaning apparatus further comprises a cleaning unit removably mounted to the upright section and including the suction motor and the air treatment member. The cleaning unit is removable from the upright section with the conduit and the hose and is useable when removed from the upright section. The outlet end of the conduit is rotatably mounted to the cleaning unit and at least one of the inlet end and the outlet end includes a releasable connection.

In some examples, the hose is releasably mounted to the inlet end.

In some examples, the outlet end is releasably mounted to the cleaning unit.

DRAWINGS

Reference is made in the detailed description to the accompanying drawings, in which.

DETAILED DESCRIPTION

Figure 1:
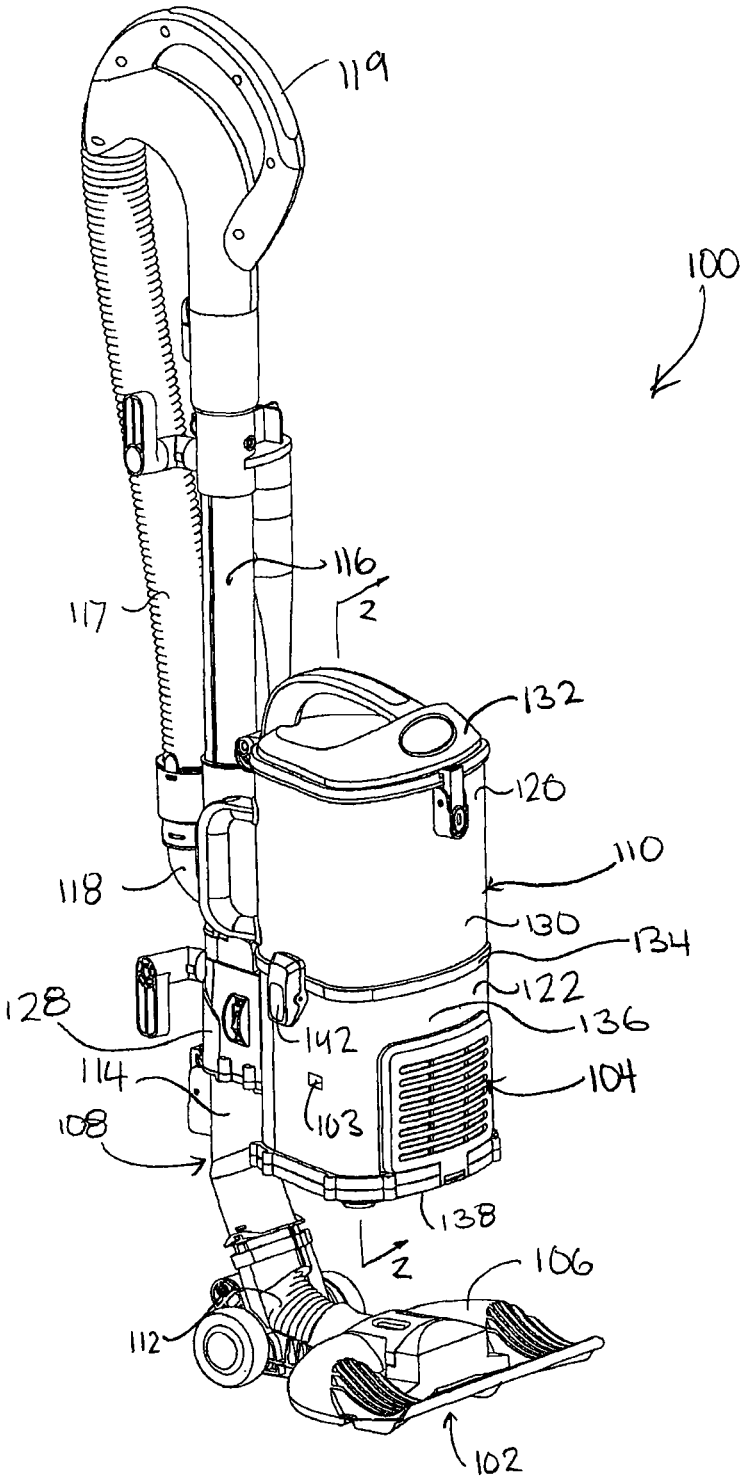
FIG. 1 is a perspective illustration of an embodiment of a surface cleaning apparatus.

Referring to FIG. 1, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

Figure 5:
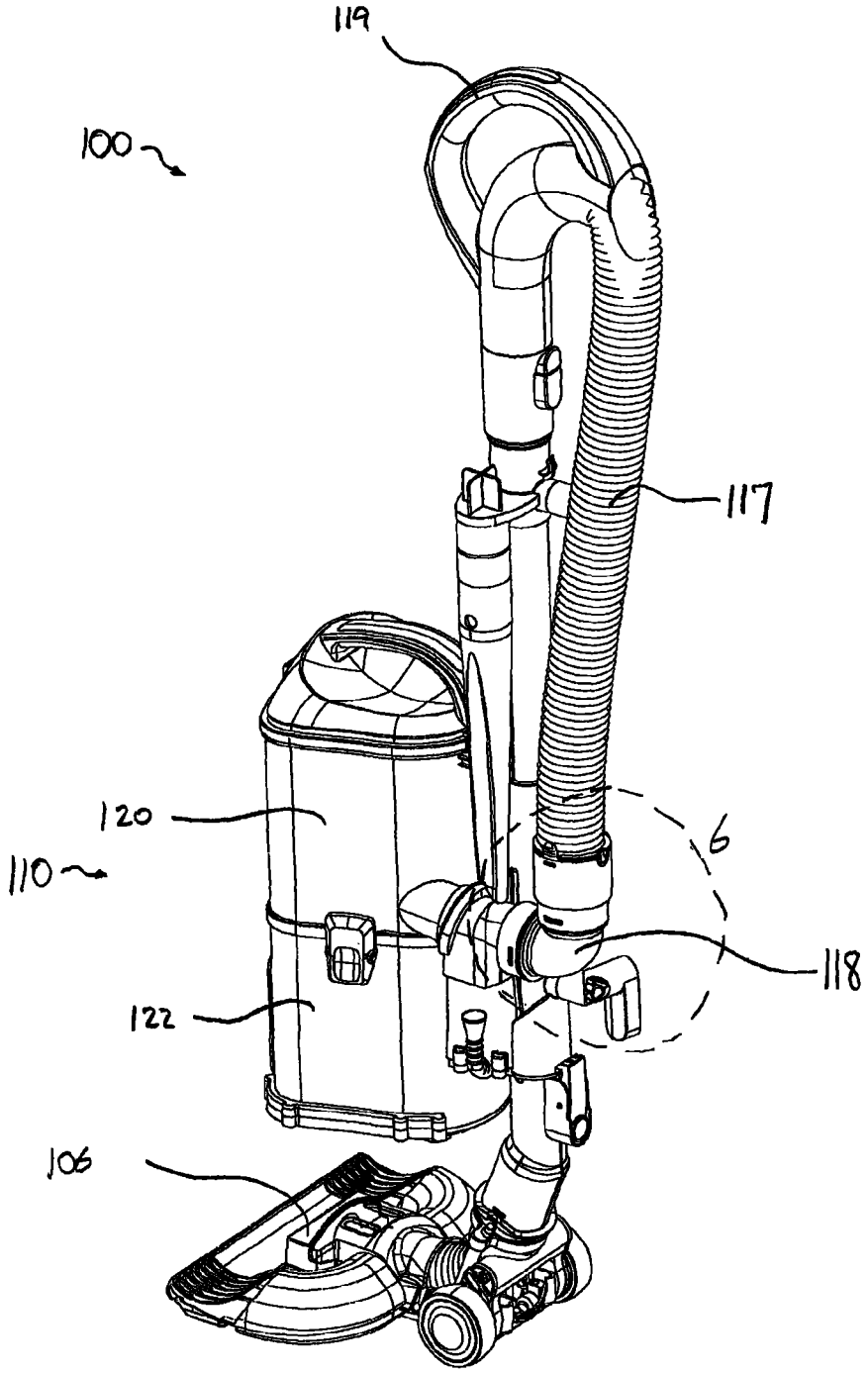
FIG. 5 is a rear perspective illustration of the surface cleaning apparatus of FIG. 1.

Referring still to FIG. 1, the surface cleaning apparatus 100 has a dirty air inlet 102, a clean air outlet 104, and an air flow passage or pathway extending therebetween. In the embodiment shown, the dirty air inlet 102 is provided in a floor cleaning head, for example surface cleaning head 106. From the dirty air inlet 102, the airflow passage extends through the surface cleaning head 106, and through an air conduit 108, to a cleaning unit, for example a suction and filtration unit 110. The clean air outlet 104 is provided in the suction and filtration unit 110. In the embodiment shown, the air conduit 108 includes a pivoting joint member 112 connected to the surface cleaning head 106, a lower upflow duct 114, an upper upflow duct 116, a hose 117, and an air flow conduit section, for example elbow joint 118. The elbow joint 118 is in airflow communication with the suction and filtration unit 110. In alternate embodiments, the air conduit 108 may be of another configuration. For example, only a pivoting joint member 112, a lower upflow duct 114, and example elbow joint 118 may be provided. Together the lower upflow duct 114 upper upflow duct 116 form an example of a support structure or upright section of the surface cleaning apparatus 100, having sufficient structural strength and rigidity to support the suction and filtration unit 110 and enable controlled manipulation of the surface cleaning head 106. The upright section is movably connected to the surface cleaning head 106, for example via pivoting joint member 112, such that the upright section can be moved from a generally vertical, storage position, as exemplified in FIGS. 1 and 5, to a generally angled use position, as exemplified in FIGS. 7 and 8. The surface cleaning apparatus 100 is generally balanced and self-supporting in the storage position.

A handle 119 is mounted to the upper upflow duct 116, for manipulating the surface cleaning apparatus 100.

Figure 2:
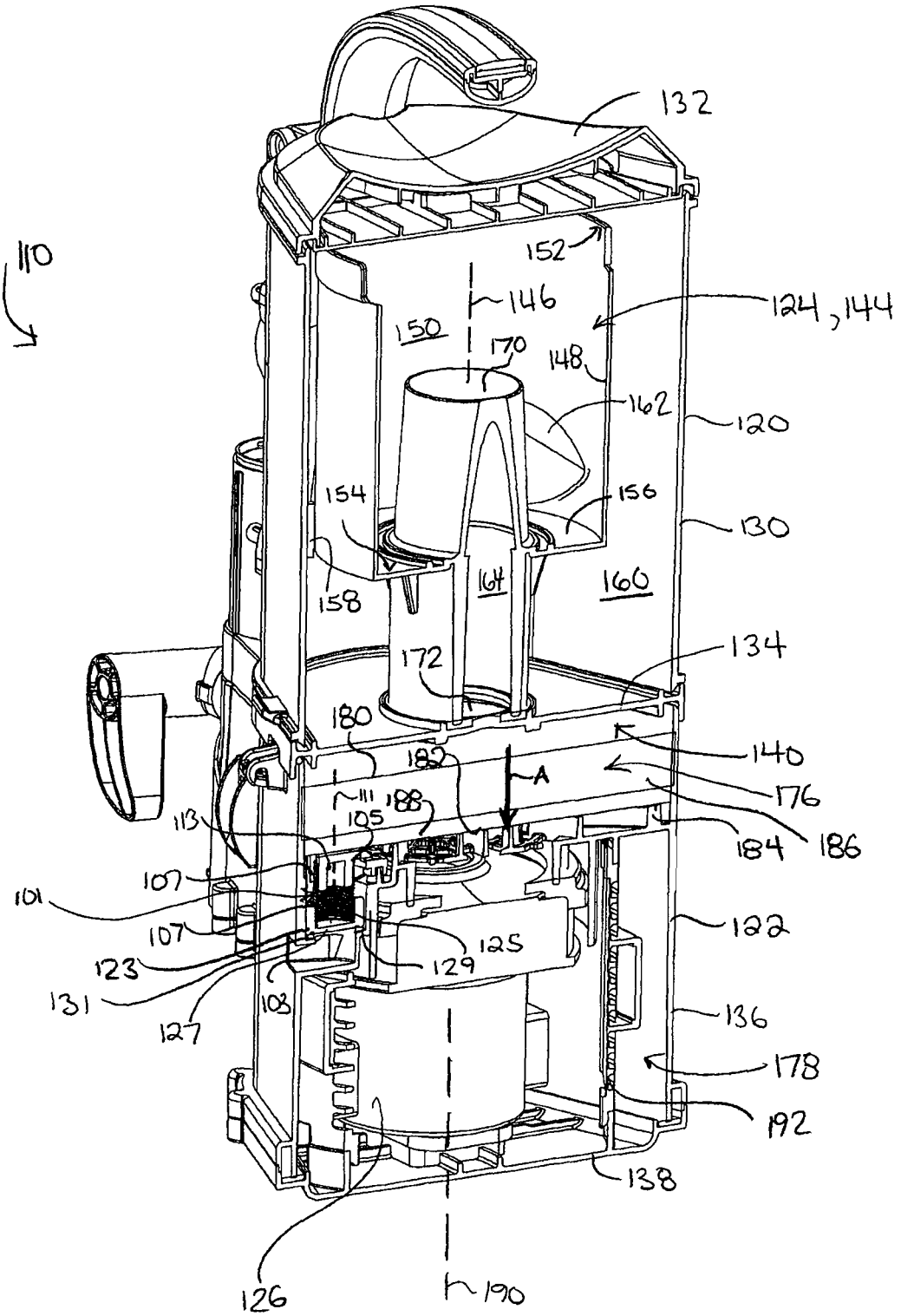
FIG. 2 is a cross section taken along line 2-2 in FIG. 1.

Referring now to FIG. 2, the suction and filtration unit 110 includes a filtration member housing 120, and a suction motor housing 122. The filtration member housing 122 houses filtration member 124, which is positioned in the airflow passage downstream of the dirty air inlet 102 for removing particulate matter from air flowing through the airflow passage. The suction motor housing 122 houses a suction motor 126, which is provided in the airflow passage downstream of the filtration member 124 for drawing air through the airflow passage.

In the embodiment shown, the suction and filtration unit 110 is supported by and mounted to the lower upflow duct 114. Particularly, a mount 128 is provided which mounts the suction and filtration unit 110 to the lower upflow duct 114. The mount 128 may be of any suitable configuration. In the embodiment shown, the mount 128 is integrally formed with the suction motor housing 122, and is mountable to the lower upflow duct 114. The mount 128 may be mountable to the lower upflow duct 114 in any suitable manner, and is preferably removably mountable to the lower upflow duct 114.

In the embodiment shown, the filtration member housing 120 includes a sidewall 130, a top wall 132, and a bottom wall 134. The suction motor housing 122 includes a sidewall 136 and a bottom wall 138, and an open top 140. The sidewall 136 of the suction motor housing 122 is removably mounted to the bottom wall 134 of the filtration member housing 120, so that the bottom wall 134 of the filtration member housing 120 seals the open top 140 of the suction motor housing 122. The sidewall 136 of the suction motor housing 122 may be removably mounted to the bottom wall 134 of the filtration member housing 120 in any suitable manner, such as by one or more latch members 142.

In the embodiment shown, as the suction motor housing 122 is mounted to the lower upflow duct 114, and the filtration member housing 120 is removably mounted to the suction motor housing 122 above the suction motor housing 122, the filtration member housing 120 may be removed from the suction motor housing by unlatching the one or more latch members 142, and lifting the filtration member housing 120 off of the suction motor housing 122. When this is done, the filtration member housing 120 will be generally sealed, except for any airflow passages leading to or from the filtration member housing 120, and the top 140 of the suction motor housing 122 will be open.

Referring still to FIG. 2, in the embodiment shown, the filtration member 124 is a cyclone 144. In alternate embodiments, the filtration member 124 may be, for example, a filter, such as a filter bag or a foam filter. In further alternate embodiments, the filtration member 124 may include a plurality of cyclones, or a plurality of cyclonic stages.

The cyclone 144 may be of any suitable configuration. In the embodiment shown, the cyclone 144 extends along a longitudinal axis 146, which is generally vertically extending, and includes a generally cylindrical cyclone wall 148, which defines a cyclone chamber 150. The upper end 152 of the cyclone wall 148 is open, and the lower end 154 of the cyclone wall includes lower wall 156. The cyclone wall 148 is positioned in the filtration member housing 120 such that it is spaced from the sidewall 130, top wall 132, and bottom wall 134 of the filtration member housing 120. A plurality of struts 158 support the cyclone wall 148 within the filtration member housing 120. The space between the lower wall 156 of the cyclone 144 and the bottom wall 134 of the filtration member housing 122 forms a dirt collection chamber 160.

The dirt collection chamber 160 may be emptied in any suitable manner. In the embodiment shown, the bottom wall 134 is pivotally mounted to the sidewall 130, and serves as an openable door. The dirt collection chamber 160 may be emptied by removing the filtration member housing 120 from the suction motor housing 124, as described hereinabove, and pivoting the bottom wall 134 away from the sidewall 130.

The cyclone 144 further includes a cyclone air inlet 162, and a cyclone air outlet 164. The cyclone air inlet 162 extends from a first end 166 that is in communication with the hose 117, through the sidewall 130 of the filtration member housing 120, to a second end 168 that is in communication with the cyclone chamber 150. The cyclone air outlet 164 extends along the axis 146, from a first end 170 that is positioned within the cyclone chamber 150, through the lower wall 156, and to a second end 172 that is in communication with the interior of the suction motor housing 122. A screen 172 is preferably mounted over the first end 170 of the cyclone air outlet.

In use, air flows from the hose 117, through the elbow 118 into the cyclone chamber 150 through the cyclone air inlet 162. In the cyclone chamber 150, the air flows within the cyclone wall 148 in a cyclonic pattern, and particulate matter is separated from the air. The particulate matter exits the cyclone chamber 150 through the first end 152, and settles in the dirt collection chamber 160. The air exits the cyclone chamber 150 through the cyclone air outlet 164, and enters the suction motor housing 122.

Referring still to FIG. 2, the suction motor housing 122 houses the suction motor 126, a pre-motor filter 176 upstream of the suction motor 126 and downstream of the cyclone 144, and a post-motor filter 178 downstream of the suction motor 126 and upstream of the clean air outlet 104.

The pre-motor filter 176 extends across the open top 140 of the suction motor housing 122, and has an upstream side 180 that faces the cyclone air outlet 164, and an opposed downstream side 182 that faces the bottom wall 138 of the suction motor housing 122. The pre-motor filter 176 is supported within the suction motor housing 122 by an apertured support wall 184 (seen most clearly in FIG. 3), which extends across the suction motor housing 122. The pre-motor filter 176 is sized to be generally snugly received within the suction motor housing 122, such that air entering the suction motor housing 122 from the cyclone air outlet 164 passes through the pre-motor filter 176, in a direction indicated by arrow A. The pre-motor filter 176 may be any suitable type of filter. Preferably, the pre-motor filter includes a foam layer 186 and a felt layer 188.

Figure 4:
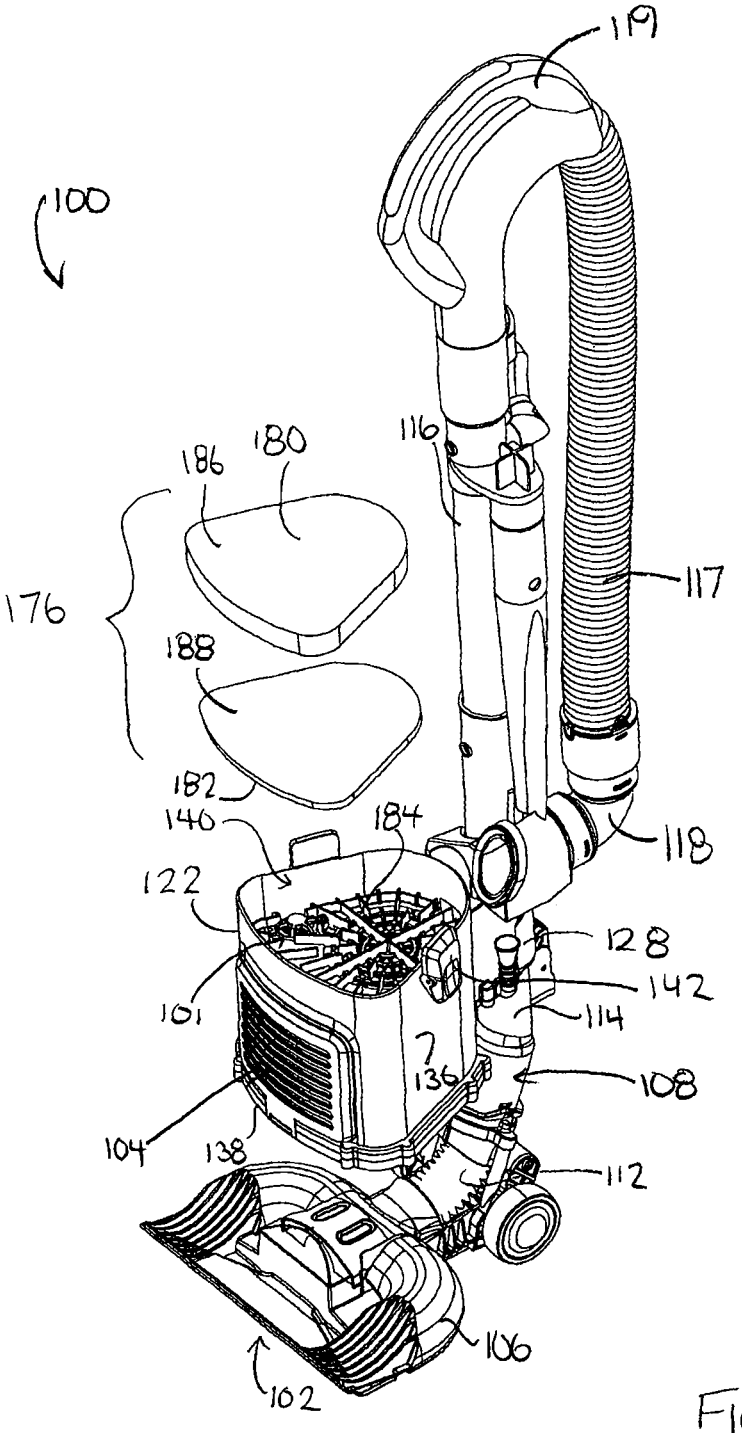
FIG. 4 is a perspective illustration of the surface cleaning apparatus of FIG. 1, with a filtration member housing removed, and a pre-motor filter exploded from the suction motor housing.

Referring to FIG. 4, when the filtration member housing 120 is lifted off of the suction motor housing 122, the pre-motor filter 176 is exposed, and may be removed, replaced, or cleaned.

Referring back to FIG. 2, the suction motor 126 is housed within the suction motor housing 122 beneath the apertured support wall 184. The suction motor 126 may be any suitable type of suction motor. In the embodiment shown, the suction motor 126 extends along a longitudinal axis 190 that is generally vertically extending.

The post motor filter 178 is housed within the suction motor housing 122 adjacent the suction motor 126, and between the suction motor 126 and the clean air outlet 104. Preferably, a second apertured wall 192 is provided between the suction motor 126 and the post-motor filter 178. The post-motor filter 178 may be any suitable type of filter, such as a HEPA filter.

It is possible that in some instances, the airflow passage may become fully or partially clogged. For example, a large object, such as a ball of hair, may become lodged anywhere in the airflow passage, such as in the surface cleaning head 106. For further example, the pre-motor filter 176 may become clogged with particulate matter. If this occurs, the suction motor 126 may burn out. Referring still to FIG. 2, a bleed-valve 101 is provided in the suction motor housing 122. If a clog occurs in the airflow passage, the pressure in the suction motor housing 122 will decrease. The bleed valve 101 is preferably configured to open when the pressure decreases, and allow air to flow through the suction motor housing 122 to the clean air outlet 104 so that the suction motor 126 does not burn out.

Referring still to FIG. 2, the bleed valve 101 includes an air inlet 103, and air outlet 105, and a longitudinally extending airflow passageway 107 extending therebetween. The air inlet 103 is preferably formed through the sidewall 136 of the suction motor housing 122, and is preferably at angle to the airflow passageway 107. The air outlet 105 is formed through the apertured support wall 184, and is positioned between the suction motor 126 and the downstream side 182 of the pre-motor filter 176. Preferably, as shown, the air outlet 105 faces the downstream side 182 of the pre-motor filter 176. More preferably, the air outlet 105 additionally faces the cyclone air outlet 164.

The airflow passageway 107 is defined by a sidewall 109 extending between the sidewall 136 of the suction motor housing 122 and the apertured support wall 184. The sidewall 109 is preferably integral with the suction motor housing 122 (in other words, the bleed valve 101 is integrally formed with the suction motor housing 122). The airflow passageway 107 extends along a longitudinal axis 111. As shown, the longitudinal axis 111 is preferably parallel with the longitudinal axis 146 of the cyclone 144 and the cyclone air outlet 164, and is preferably aligned with the longitudinal axis 190 of the suction motor 126. Further, the airflow passageway 107 is preferably aligned with a direction of flow (as shown by arrow A) through the pre-motor filter 176.

The bleed valve 101 may be opened and closed in any suitable manner, and is preferably opened automatically when the pressure in the suction motor housing 122 decreases. In the embodiment shown, the bleed valve 101 includes an actuating member 113. The actuating member 113 includes a cap 115, that is mounted to the apertured support wall 184 over the air outlet 105 of the bleed valve 101. The cap 115 has apertures 121 therethrough, to allow air to flow out of the air outlet 105. A bearing member 123 is suspended from the cap 115 by a spring 125. The bearing member 123 includes a lower plate 127 that has a diameter that is slightly less than the diameter of the portion of the airflow passage 107 adjacent the lower plate 127. The sidewall 109 of the airflow passage includes a shelf 129, and a seal 131 is seated on and secured to the shelf 129, facing the lower plate 127. During normal use of the surface cleaning apparatus, the spring 125 forces the lower plate 127 against the seal 131, so that air cannot flow between the lower plate 127 and the seal 127, and cannot flow through the airflow passage 107. When the pressure in the suction motor housing 122 decreases enough to overcome the spring force of the spring 125, the lower plate 127 will lift away from the seal 131, so that air may flow laterally between the lower plate 127 and the seal 131, and upwardly between the lower plate 127 and the sidewall 109.

Figure 3:
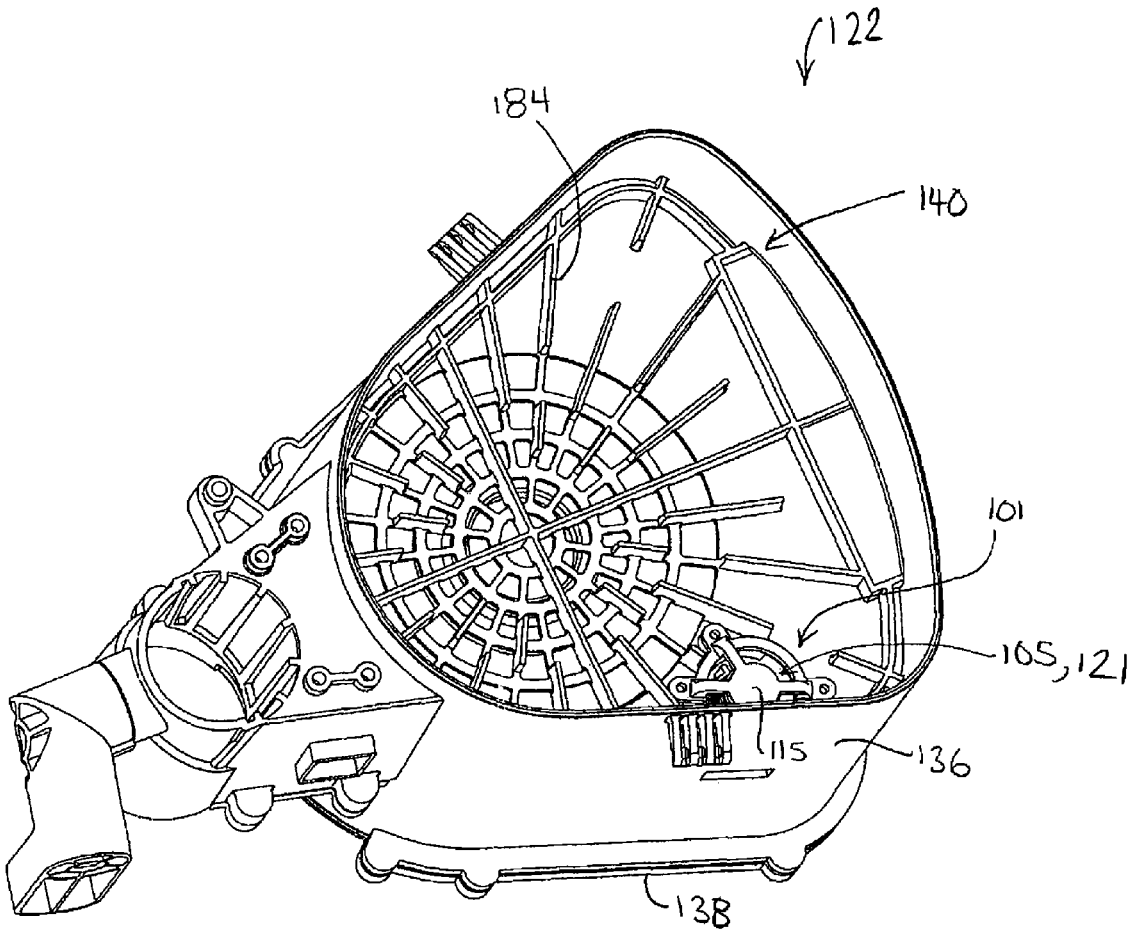
FIG. 3 is a perspective illustration of a suction motor housing of the surface cleaning apparatus of FIG. 1.

Referring to FIG. 3, when the pre-motor filter 176 is removed from the suction motor housing 122, the air outlet 105 of the bleed valve 101 is preferably visible.

Referring now to FIGS. 5, 6, 9 and 10, in the present embodiment the air flow pathway extending from the dirty air inlet to the clean air outlet includes elbow 118 for fluidly connecting the hose 117 to the cyclone air inlet 162. The elbow 118 includes an upstream or inlet end 300 that is in fluid connection with a downstream or outlet end 302. The inlet end 300 defines an inlet axis 304 that generally coincides with the direction of the air flow entering the inlet end. The outlet end 302 defines an outlet axis 306 that generally coincides with the direction of the air flow exiting the elbow 118 via the outlet end 302. As exemplified in FIG. 6, the elbow outlet end 302 can be generally aligned with the cyclone air inlet 162, so that outlet axis 306 extends through the approximate centre of the air inlet 162. Optionally, the elbow 118 can be connected to the suction and filtration unit 110 so that the outlet end 302 of the elbow is not aligned with cyclone air inlet 162.

In the present example, the elbow 118 is a generally tubular, hollow conduit subtending approximately 90 degrees so that the inlet axis 302 is generally orthogonal to the outlet axis 306. In other examples, the elbow 118 can subtend an angle other than 90 degrees, for example 60 degrees or 120 degrees, or can be a straight tube. Elbow 118 is configured to provide a movable coupling between the suction and filtration unit 110 and the downstream end of the air flow pathway, for example the downstream end of hose 117. In the present example, the inlet end 300 is rotatably connected to the hose 117 and the outlet end 302 is rotatably connected to the suction and filtration unit 110.

Figure 7:
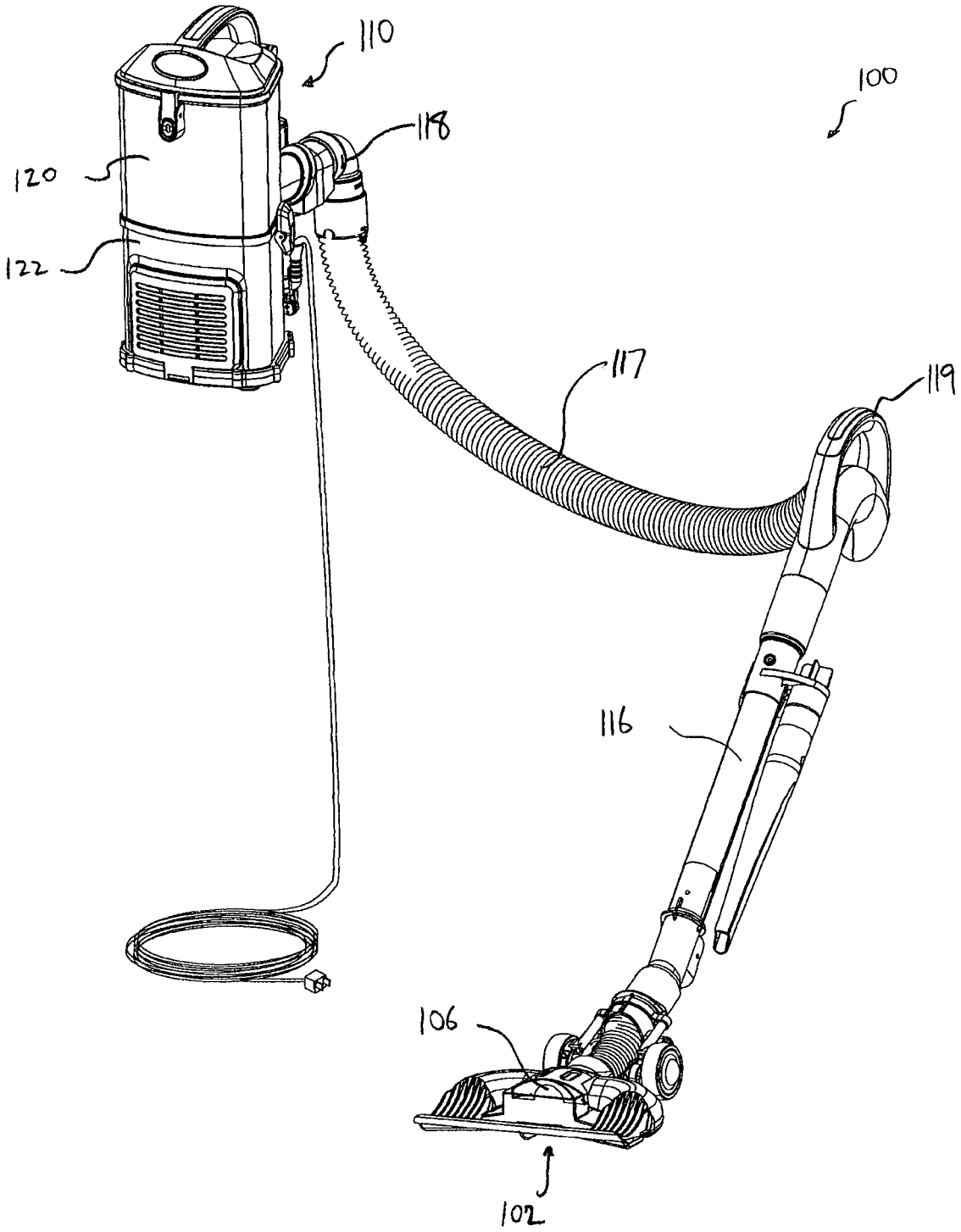
FIG. 7 is a perspective illustration of the surface cleaning apparatus of FIG. 1 with the cleaning unit detached and in a first position.
Figure 8:
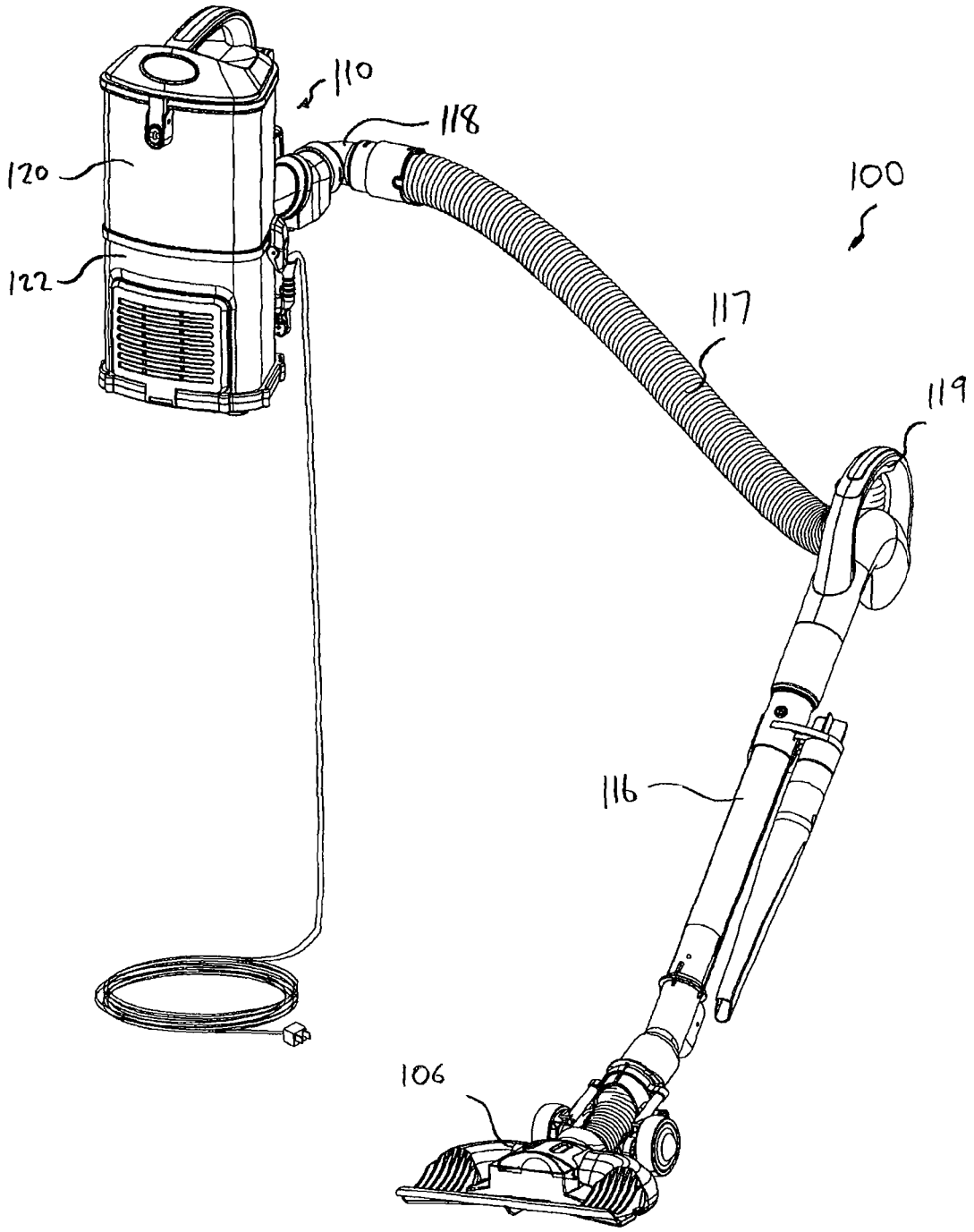
FIG. 8 is a perspective illustration of the surface cleaning apparatus of FIG. 7 with the cleaning unit detached and in a second position.

In some cleaning situations a user may wish to detach the cleaning unit, for example the suction and filtration unit 110, from the support structure and operate the surface cleaning apparatus 100 in a portable operating mode, e.g., carry the cleaning unit by hand or by a strap while still using the support structure to drivingly maneuver the surface cleaning head 106, as exemplified in FIGS. 7 and 8. When the suction and filtration unit 110 is detached, a user may more easily maneuver the surface cleaning head 106 around or under obstacles, like furniture and stairs.

To enable the vacuum suction generated by the suction and filtration unit 110 to reach the surface cleaning head 106 when the suction and filtration unit 110 is detached from the support structure, the air flow pathway or connection between the surface cleaning head 106 and the suction and filtration unit 110 is preferably at least partially formed by a flexible conduit, such as a flexible hose 117. In the present example, the use of a flexible hose 117 enables a user to detach the suction and filtration unit 110 and maintain an air flow connection between the suction and filtration unit 110 and the surface cleaning head 106 optionally, without having to reconfigure or reconnect any portions of the air flow pathway.

While a resilient hose 117 provides a certain degree of freedom or flexibility for a user, certain actions by the use, such as changing the position of the suction and filtration unit 110 relative to the support structure, may increase the likelihood of tangling or kinking the flexible hose 117 or may exert tension or torsion forces against a user holding the suction and filtration unit 110 due to the inherent resiliency of the flexible hose 117.

As exemplified in FIGS. 7 and 8, having two rotatable connections, one at each end of the elbow 118, can reduce the likelihood of tangling or kinking the flexible hose 117 as the elbow connection 118 can rotate between a plurality of positions relative to the suction and filtration unit 110 and the flexible hose 117 can rotate relative to the elbow 118. FIG. 7 shows the suction and filtration unit 110 in a first position relative to the support structure, in which the elbow 118 is in a first orientation. When the suction and filtration unit 110 is moved, as shown in FIG. 8, forces exerted by the flexible hose 117 (or any other portion of the surface cleaning apparatus 100) that would otherwise be passed on the user holding the suction and filtration unit 110 may be at least partially mitigated by the automatic movement of elbow 118 to a second position. Reducing tension and torsion forces carried in the air flow path, by providing the two, rotation couplings on elbow 118, may also reduce stress and wear on components of the surface cleaning apparatus 110.

Figure 9:
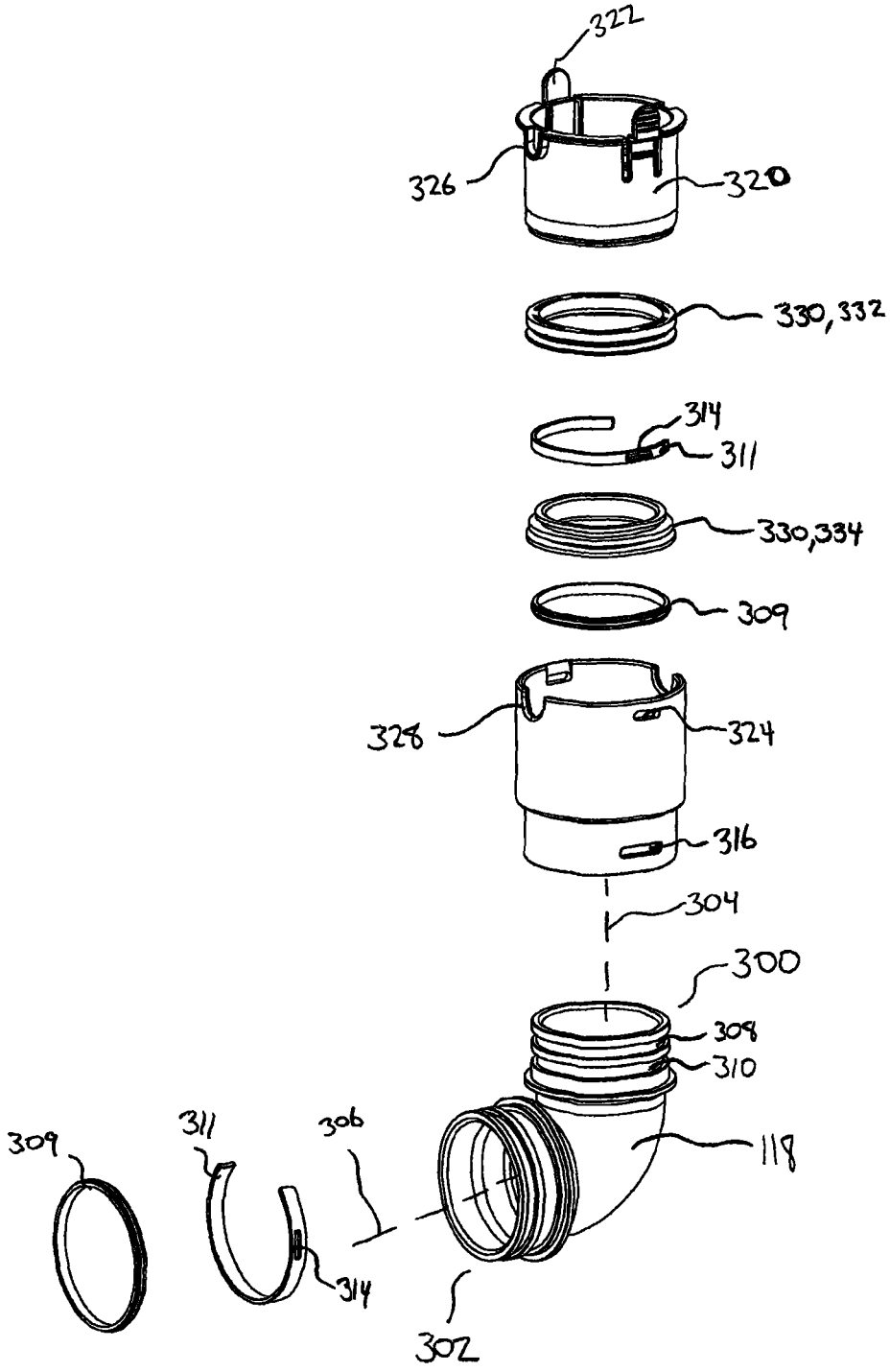
FIG. 9 is a perspective, exploded view of an example of an air flow conduit; and, FIG. 10 is a side elevation, exploded view of the air flow conduit of FIG. 9.
Figure 10:
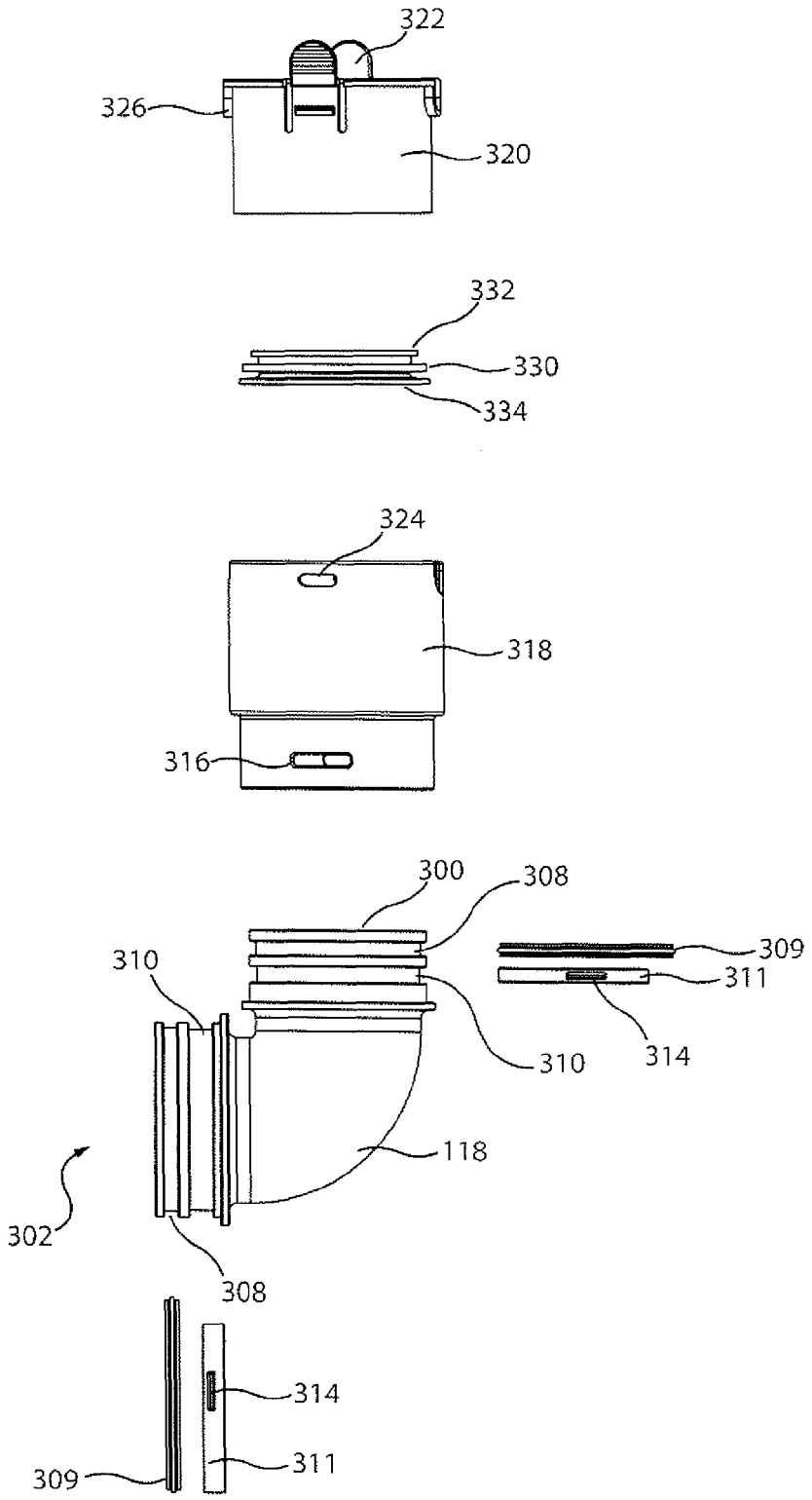

Referring to FIGS. 9 and 10, exploded views of one example of the rotational connections provided on elbow 118. In the example shown, the inlet and outlet ends 300, 302 of the elbow 118 comprise substantially similar connection features, including seal grooves 308, for receiving sealing member such as o-rings 309, and securement grooves 310, for receiving securement members such as locking rings 311.

Figure 6:
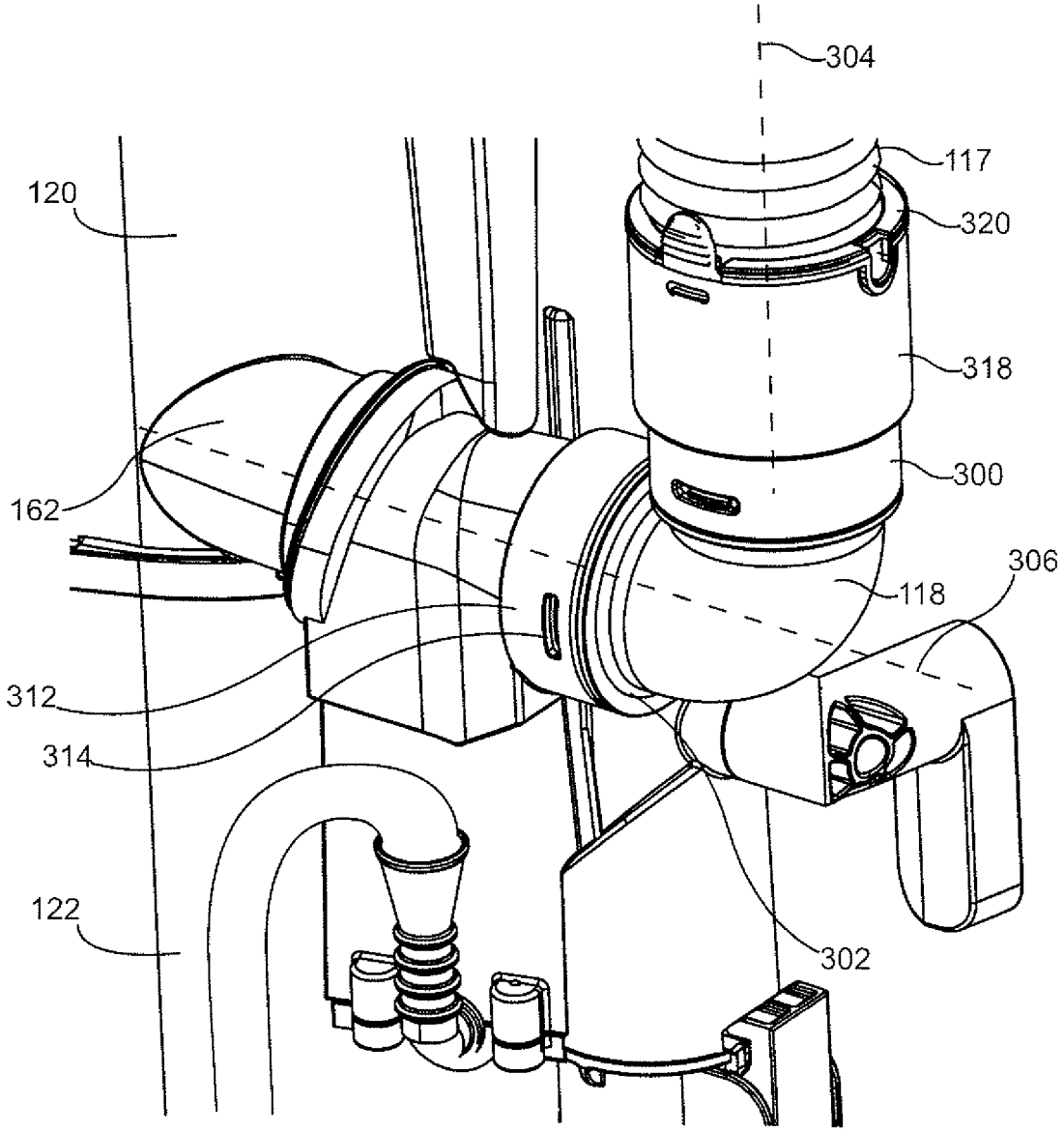
FIG. 6 is a detail view of a portion of the surface cleaning apparatus of FIG. 5 contained within detail line 6.

To provide the rotatable connection between the elbow 118 and the suction and filtration unit 110, the outlet end 302 of the elbow 118 is inserted into a corresponding cavity or slot in the suction and filtration unit 110, for example housing sleeve 312, as exemplified in FIG. 6. In this example, the housing sleeve 312 is a generally tubular member having an inner diameter sized to receive the outlet end 302 and generally smooth inner surface for contacting and sealing against o-ring 309. Contact between the o-ring 309 and the inner surface of the housing sleeve 312 provides a generally air-tight seal between the elbow 118 and the housing sleeve 312, while still allowing relative rotation therebetween.

To assemble the rotatable connection, the o-ring 309 can be seated within the corresponding sealing groove 308 and locking ring 311 can be seated in corresponding securement groove 310. Locking ring 311 is freely rotatable within the securement groove 310. The outlet end 302 can then be inserted axially (in the direction of axis 306) into the housing sleeve 312 to establish the air-tight, rotatable seal between the elbow 118 and the inner surface of the sleeve housing 312. When inserted to a predetermined locking position, barbs 314 on the outer, peripheral surface of the locking ring 311 extend into and engage corresponding slots 316 in the sleeve housing 312. The engagement between the barbs 314 and slots 316 prevents relative axial motion between the locking ring 311 and the housing sleeve 312, and side walls of the securement groove 310 prevent relative axial movement between the locking ring 311 and the elbow 118, thereby retaining the outlet end 302 within the housing sleeve 312. Optionally the rotatable connection between the outlet end 302 and the suction and filtration unit 110 and/or the rotatable connection between the inlet end 300 and the flexible hose 117 can be releasably connections, enabling a user to selectably attached and detach either or both connections.

The releasable, rotatable connections can be any suitable type of connection, for example the barbs 314 may be selectably disengageable from the slots 316 to allow the outlet end 302 of the elbow 118 to be slidingly removed from the sleeve housing 312.

While shown as being through holes, in other examples the slots 316 may be close-bottom dimples or depressions in the inner surface of the housing sleeve 314 and may not extend completely through the housing sleeve 314.

To rotatably connect the elbow 118 to the flexible hose 117, the inlet end 300 of the elbow 118 can be connected to a hose sleeve 318 in the same manner that the outlet end 302 is connected to the housing sleeve 312, as described in detail above. Connecting the hose sleeve 318 and inlet end 300 in this manner can provide the desired rotatable, optionally detachable air-tight connection. The hose 117 can be connected to the hose sleeve 318 in any suitable manner known in the art. Optionally, as exemplified, the connection between the hose 117 and the hose sleeve 318 can be configured to be a detachable or releasably connection.

In this example, the hose 117 can be fixedly attached to a rigid hose cuff 320 using any suitable means, including adhesives, welding and friction fits. The hose cuff 320 is configured to nest within an upstream, or inlet end of the hose sleeve 318. The hose cuff 320 comprises a pair of opposing, resilient tab members 322 that can engage respective slots or notches 324 in the upstream end of the hose sleeve 318. To connect the hose cuff 320 to the hose sleeve 318, a user can axially insert the hose cuff 320 into the hose sleeve 318 (along the direction of axis 304) so that tabs 322 can engage notches 324, thereby inhibiting removal of the hose cuff 320. Relative rotation between the hose sleeve 318 and the hose cuff 320 (i.e. about axis 304) can be inhibited by protrusions 326 on the surface of the sleeve cuff 320 that can be nested within corresponding seats 328 provided in the hose sleeve 318.

A user can detach hose cuff 320 from hose sleeve 318 by squeezing tabs 322 until they are disengaged from notches 324, and then axially removing the hose cuff 320 from the hose sleeve 320.

In some examples, the hose cuff 320 and hose sleeve 318 can cooperate to create a detachable, air-tight seal when connected. In other examples, as exemplified in FIGS. 9 and 10, a cuff sealing apparatus 330 can be provided to provide an air-tight seal between the hose cuff 320 and the hose sleeve 318. The cuff sealing apparatus can be any suitable sealing member or a combination of members. In the present example, the cuff sealing apparatus comprises a seal carrier 332 and seal 334.

In some examples the conduit section rotatably connecting the suction and filtration unit to the air flow path, for example hose 117, can comprise both the elbow 118 and the housing sleeve portion 312 of the suction and filtration unit 110. In these examples, the outlet end of the conduit can include portions of both the elbow and housing sleeve 312.

In other examples, the outlet end 302 of the conduit can be coupled directly to the cyclone air inlet 162, without the need for an intervening portion of the suction and filtration unit housing. In some examples, the outlet end 302 of the conduit can define an outlet plane 336 (FIG. 10) and the cyclone air inlet 162 can define a cyclone inlet plane, that contains the opening of the cyclone air inlet 162. Optionally, the outlet plane 336 and the cyclone inlet plane are co-extensive, so that the conduit outlet end 302 and the cyclone air inlet 162 lie in a common plane.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. An upright surface cleaning apparatus comprising:

(a) a floor cleaning head having a dirty air inlet;

(b) an upright section moveably mounted to the surface cleaning head between a storage position and an in use position and comprising a removably mounted portable cleaning unit;

(c) an air flow passage extending from the dirty air inlet to a clean air outlet and including at least a flexible hose and a conduit section, the flexible hose and the conduit section removable with the portable cleaning unit;

(d) the portable cleaning unit comprising a suction motor and an air treatment member positioned in the air flow passage, the cleaning unit useable when removed from the upright section;

(e) the conduit section having an inlet end and an outlet end, the inlet end of the conduit is rotatably connected to a downstream end of the flexible hose about an axis parallel to air flow through the inlet end.

2. The surface cleaning apparatus of claim 1 wherein the outlet end of the conduit is rotatably mounted to the cleaning unit.

3. The surface cleaning apparatus of claim 1 wherein the conduit section comprises an elbow.

4. The surface cleaning apparatus of claim 1 wherein the inlet and outlet ends are oriented in differing directions.

5. The surface cleaning apparatus of claim 4 wherein the conduit section comprises an elbow.

6. The surface cleaning apparatus of claim 1 wherein end of the flexible hose is releasably mounted to the inlet end.

7. The surface cleaning apparatus of claim 6 wherein the outlet end of the conduit section is rotatably mounted to the cleaning unit and the outlet end is releasably mounted to the cleaning unit.

8. The surface cleaning apparatus of claim 1 wherein the outlet end of the conduit section is rotatably mounted to the cleaning unit and the outlet end is releasably mounted to the cleaning unit.

9. The surface cleaning apparatus of claim 1 wherein the air treatment member comprises a cyclone having an air inlet and the outlet end of the conduit section is linearly aligned with the air inlet of the cyclone.

10. The surface cleaning apparatus of claim 1 wherein the air treatment member comprises a cyclone having an air inlet and the outlet end of the conduit section and the air inlet of the cyclone are in a common plane.

11. The surface cleaning apparatus of claim 1 wherein the end of the flexible hose is releasably mounted to the inlet end.

12. The surface cleaning apparatus of claim 1 wherein the outlet end is releasably mounted to the cleaning unit.

13. The surface cleaning apparatus of claim 1, wherein the conduit section comprises a rigid elbow having the inlet end and the outlet end.

14. The surface cleaning apparatus of claim 1, wherein an upstream end of the flexible hose is connected to a handle assembly.

15. The surface cleaning apparatus of claim 14, wherein the handle assembly is operative connected to a downstream end of an above floor cleaning wand.

16. The surface cleaning apparatus of claim 15, wherein an opposed upstream end of the upflow duct is connectable to the surface cleaning head.

17. The surface cleaning apparatus of claim 1, wherein the flexible hose comprises part of the air flow path when the cleaning unit is mounted to the upright section and when the cleaning unit is detached from the upright section.

18. An upright surface cleaning apparatus comprising:

(a) a floor cleaning head having a dirty air inlet;

(b) an upright section moveably mounted to the surface cleaning head between a storage position and an in use position;

(c) an air flow passage extending from the dirty air inlet to a clean air outlet and including at least a rigid conduit section and a flexible hose upstream from the conduit section;

(d) a cleaning unit detachably mounted to the upright section and comprising a suction motor and an air treatment member in the air flow passage, the air treatment member comprising an air treatment housing detachable from the cleaning unit and comprising an air treatment inlet; and (e) the rigid conduit section provided on the cleaning unit and having an inlet end and an outlet end, the inlet end is connected to a downstream end of the flexible hose and the outlet end is connected to the cleaning unit upstream of the air treatment inlet, and at least the inlet end is rotatably connected to the downstream end of the flexible hose or the outlet end is rotatably connected to the cleaning unit about an axis parallel to air flow through the outlet end;

wherein, when the air treatment housing is detached from the cleaning unit, the outlet end of the rigid conduit section is exposed.

19. The surface cleaning apparatus of claim 18, wherein the inlet end is rotatably connected to the downstream end of the flexible hose and the outlet end is rotatably mounted to the cleaning unit.

20. The surface cleaning apparatus of claim 18, wherein the flexible hose is removably mounted to the inlet end.

21. An upright surface cleaning apparatus comprising:

(a) a floor cleaning head having a dirty air inlet;

(b) an upright section moveably mounted to the surface cleaning head between a storage position and an in use position and comprising an upflow duct;

(c) an air flow passage extending from the dirty air inlet to a clean air outlet and including at least the upflow duct, a conduit section and a flexible hose disposed downstream of the upflow duct and upstream from the conduit section;

(d) a cleaning unit detachably mounted to the upright section and comprising a suction motor and an air treatment member positioned in the air flow passage, the cleaning unit being operable in a first configuration wherein the cleaning unit is detached from the upright section and is in air flow communication with the floor cleaning head via the conduit section, the flexible hose and the upflow duct and in a second configuration wherein the cleaning unit is mounted to the upright section and is in air flow communication with the floor cleaning head via the conduit section, the flexible hose and the upflow duct; and (e) the conduit section having an inlet end connected to a downstream end of the flexible hose and an outlet end connected to the cleaning unit, at least the inlet end is rotatable relative to the flexible hose about a first axis parallel to air flow through the inlet end or the outlet end is rotatable relative to the cleaning unit about a second axis parallel to air flow through the outlet end.

22. The surface cleaning apparatus of claim 21, wherein the conduit section comprises a rigid elbow having the inlet end and the outlet end, and wherein the first axis is non-parallel to the second axis.

* * * * *

UNITED STATES PATENT AND TRADEMARK OFFICE

CERTIFICATE OF CORRECTION

PATENT NO. : 8,875,340 B2
APPLICATION NO. : 12/722874
DATED : November 4, 2014
INVENTOR(S) : Wayne Ernest Conrad It is certified that error appears in the above-identified patent and that said Letters Patent is hereby corrected as shown below:

In the Claims,

Column 10, line 21, Claim 6 should read "The surface cleaning apparatus of claim 1 wherein the end of the flexible hose is releasably mounted to the inlet end."; and Column 11, line 23, Claim 20 should read "The surface cleaning apparatus of claim 19 wherein the flexible hose is removably mounted to the inlet end.".

Signed and Sealed this
Seventeenth Day of February, 2015

Michelle K. Lee

Michelle K. Lee
*Deputy Director of the United States Patent and Trademark Office*